US009188891B2

(12) United States Patent
Zhou et al.

(10) Patent No.: US 9,188,891 B2
(45) Date of Patent: Nov. 17, 2015

(54) SUPER LOW MELT TONER HAVING CRYSTALLINE AROMATIC ETHERS

(71) Applicant: XEROX CORPORATION, Norwalk, CT (US)

(72) Inventors: Ke Zhou, Oakville (CA); Jordan H. Wosnick, Toronto (CA); Kentaro Morimitsu, Mississauga (CA); Michael S. Hawkins, Cambridge (CA); Edward G. Zwartz, Mississauga (CA); Valerie M. Farrugia, Oakville (CA)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/076,822

(22) Filed: Nov. 11, 2013

(65) Prior Publication Data

US 2015/0132691 A1 May 14, 2015

(51) Int. Cl.

| | |
|---|---|
| ***G03G 9/08*** | (2006.01) |
| ***G03G 9/097*** | (2006.01) |
| ***G03G 9/087*** | (2006.01) |
| ***G03G 9/00*** | (2006.01) |

(52) U.S. Cl.

CPC ..... *G03G 9/0821* (2013.01); *G03G 9/00* (2013.01); *G03G 9/0804* (2013.01); *G03G 9/087* (2013.01); *G03G 9/097* (2013.01)

(58) Field of Classification Search

CPC ..... G03G 9/06; G03G 9/081; G03G 9/0821; G03G 9/097; G03G 9/087; G03G 9/00; G03G 9/0804

USPC ..... 430/108.1, 109.1, 137.1

See application file for complete search history.

(56) References Cited

U.S. PATENT DOCUMENTS

| | | | | |
|---|---|---|---|---|
| 5,290,654 | A | 3/1994 | Sacripante et al. | |
| 5,302,486 | A | 4/1994 | Patel et al. | |
| 5,529,874 | A * | 6/1996 | Kobayashi et al. | 430/116 |
| 6,063,827 | A | 5/2000 | Sacripante et al. | |
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 7,547,499 | B2 | 6/2009 | Veregin et al. | |
| 7,651,747 | B2 * | 1/2010 | Chen et al. | 428/32.25 |
| 7,790,343 | B2 * | 9/2010 | Suzuki et al. | 430/109.4 |
| 2006/0222991 | A1 | 10/2006 | Sacripante et al. | |
| 2011/0129774 | A1 * | 6/2011 | Farrugia et al. | 430/108.14 |

* cited by examiner

*Primary Examiner* — Thorl Chea

(74) *Attorney, Agent, or Firm* — Pillsbury Winthrop Shaw Pittman LLP

(57) ABSTRACT

A toner includes a polymeric resin, optionally a colorant, and a small molecule crystalline aromatic ether having a molecular weight less than 1,000 g/mol. The polymeric resin may be an amorphous resin and a mixture of the amorphous resin and the crystalline aromatic ether may be characterized by a reduction in glass transition temperature from that of the resin and by the lack of a melting point for the crystalline aromatic ether as determined by differential scanning calorimetry, the enthalpy of fusion for the crystalline aromatic ether in the mixture being measured to be less than 10% of the enthalpy of fusion of the crystalline aromatic ether in pure form. Furthermore, the toner may be configured to have a crease fix minimum fusing temperature (MFT) less than or equal to the crease fix MFT of a benchmark ultra-low-melt emulsion aggregation toner. Suitable crystalline aromatic ethers may include benzyl 2-naphthyl ether.

17 Claims, 4 Drawing Sheets

SUPER LOW MELT TONER HAVING CRYSTALLINE AROMATIC ETHERS

CROSS-REFERENCE TO RELATED APPLICATIONS

This application is related to U.S. application Ser. No. 14/077,024, entitled "Super Low Melt Toner Having Small Molecule Plasticizers", U.S. Appl. Ser. No. 14/076,712, entitled "Super Low Melt Toner Having Crystalline Imides", U.S. application Ser. No. 14/076,950, entitled "Super Low Melt Toner Having Crystalline Aromatic Monoesters", and U.S. application Ser. No. 14/076,575, entitled "Super Low Melt Toner Having Crystalline Diesters with an Aromatic Core", all filed on even date herewith and all disclosures of which are incorporated herein by reference in their entirety.

TECHNICAL FIELD

The presently disclosed embodiments are generally directed to toner compositions that include crystalline aromatic ethers. More specifically, the presently disclosed embodiments are directed to toner compositions that include small molecule crystalline aromatic ether compounds which are compatible with toner binder resins to provide low crease fix minimum fusing temperature.

BACKGROUND

Electrophotography, which is a method for visualizing image information by forming an electrostatic latent image, is currently employed in various fields. The term "electrostatographic" is generally used interchangeably with the term "electrophotographic." In general, electrophotography comprises the formation of an electrostatic latent image on a photoreceptor, followed by development of the image with a developer containing a toner, and subsequent transfer of the image onto a transfer material such as paper or a sheet, and fixing the image on the transfer material by utilizing heat, a solvent, pressure and/or the like to obtain a permanent image.

Crease fix Minimum Fusing Temperature (MFT) is a measurement used to determine the performance and energy efficiency of a particular toner in combination with a specific paper type and a specific fuser (which fixes the toner on the paper). Crease fix MFT is measured by folding the paper across a solid fill area of an image and then rolling a defined mass across the folded area. The paper can also be folded using a commercially available folder such as the Duplo D-590 paper folder. A plurality of sheets of paper with images that have been fused over a wide range of fusing temperatures are prepared. The sheets of paper are then unfolded and toner that has been loosened from the sheet of paper is wiped from the surface. Optical comparison of the crease area is then made to a reference chart which provides a definition of an acceptable level of toner adhesion; alternatively, the crease area may be quantified by computer image analysis. The smaller the area which has lost toner, the better the toner adhesion, and the temperature required to achieve an acceptable level of adhesion is defined as the crease fix MFT.

Currently, Ultra-Low-Melt (ULM) emulsion aggregation (EA) toners, such as described in U.S. Pat. No. 7,547,499 for example, have benchmark crease fix MFT of approximately −20° C. relative to styrene/acrylate EA toners. This improved crease fix MFT performance enables a reduction in fuser energy and enhanced fuser life when compared with EA toners. There is a desire to reduce the MFT even further, by an additional 10° C. to 20° C., for example.

BRIEF SUMMARY

In embodiments, there is provided a toner comprising: a polymeric resin: optionally a colorant; and a small molecule crystalline aromatic ether having a molecular weight less than 1,000 g/mol.

Another embodiment provides an emulsion aggregation toner comprising: an amorphous polymeric resin; optionally a colorant; and a small molecule crystalline aromatic ether having a molecular weight less than 500 g/mol, and a melting point less than about 120° C.; wherein a mixture of the amorphous polymeric resin and the small molecule crystalline aromatic ether is characterized by a reduction in glass transition temperature from that of the amorphous polymeric resin and by the lack of a significant solid to liquid phase transition peak for the small molecule crystalline aromatic ether as determined by differential scanning calorimetry, the enthalpy of fusion for the small molecule crystalline aromatic ether in the mixture being measured to be less than 10% of the enthalpy of fusion of the small molecule crystalline aromatic ether in pure form.

In yet another embodiment, there is provided a method of making toner particles comprising: admixing polymeric amorphous resin emulsion, optionally at least one colorant emulsion, an optional wax emulsion, and a small molecule crystalline aromatic ether emulsion, the small molecule crystalline aromatic ether having a molecular weight less than 1,000 g/mol, to form a composite emulsion; and adding an aggregating agent to the composite emulsion to form emulsion aggregated toner particles.

DETAILED DESCRIPTION

Figure 1:
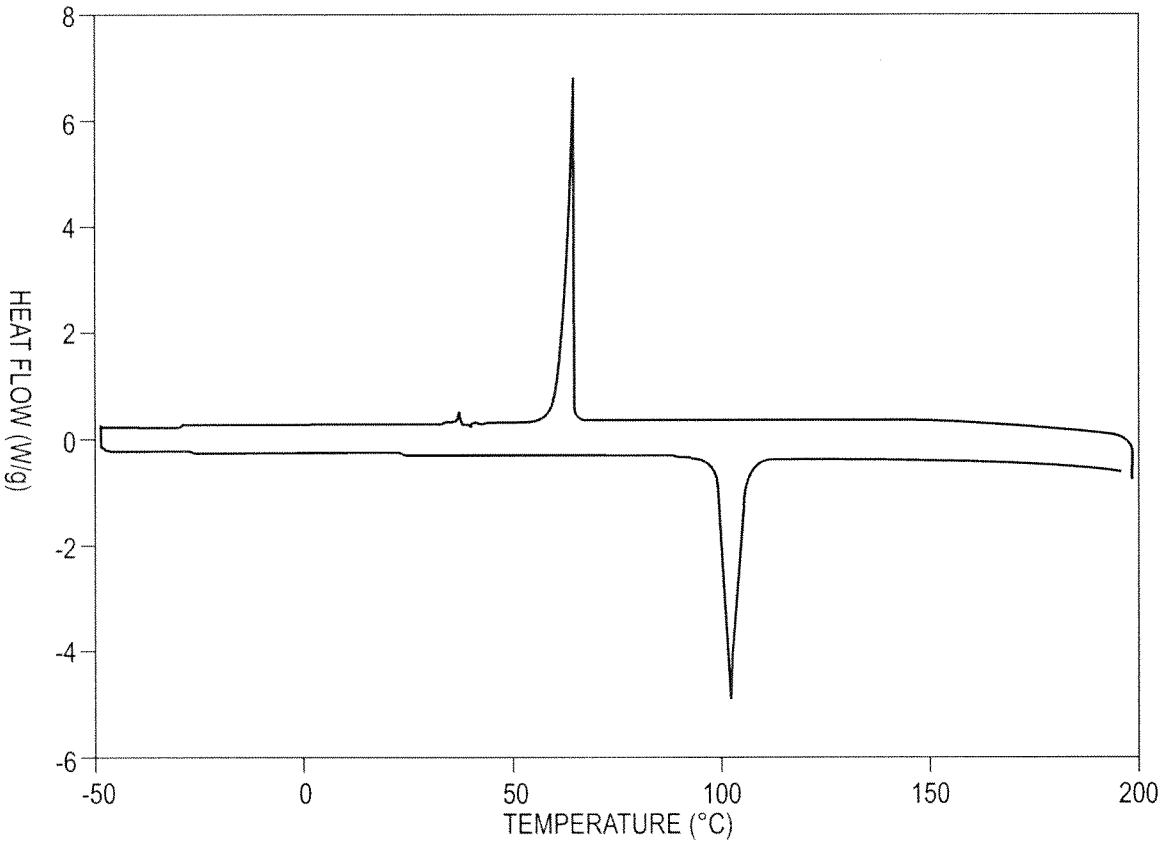
FIG. 1 is a differential scanning calorimetry (DSC) curve of benzyl 2-naphthyl ether.

In accordance with the present disclosure, toners are provided which include small molecule crystalline aromatic ethers. In embodiments, the toner may comprise small molecule crystalline aromatic ethers and an amorphous polymeric resin, wherein a mixture of the amorphous polymeric resin and the small molecule crystalline aromatic ethers is characterized by a reduction in glass transition temperature from that of the amorphous polymeric resin and by the lack of a significant solid to liquid phase transition peak for the small molecule crystalline aromatic ethers as determined by differential scanning calorimetry. For example, the lack of a significant solid to liquid phase transition peak may be demonstrated by the enthalpy of fusion for the small molecule crystalline aromatic ethers in the mixture being measured to be less than 20% of its original value, in embodiments less than 10% of its original value, and in some embodiments less than 5% of its original value, said original value representing the enthalpy of fusion for the small molecule when measured independently; this characterizes compatibility of the small molecule crystalline aromatic ethers with the amorphous polymeric resin. Furthermore, in some embodiments the small molecule crystalline aromatic ethers may have a melting point of less than 120° C. According to some embodiments, emulsion aggregation (EA) toners comprising small molecule crystalline aromatic ethers may achieve crease fix MFT at least comparable to nominal ULM EA toners, such as the Xerox® 700 Digital Color Press (DCP) toner available from Xerox Corp., for example, if not lower, by at least 5° C., or by 10° C. to 20° C., for example.

Resins

Any toner resin may be utilized in the processes of the present disclosure. Such resins, in turn, may be made of any suitable monomer or monomers via any suitable polymerization method. In embodiments, the resin may be prepared by a method other than emulsion polymerization. In further embodiments, the resin may be prepared by condensation polymerization.

In embodiments, the resin may be a polyester, polyimide, polyolefin, polyamide, polycarbonate, epoxy resin, and/or copolymers thereof. In embodiments, the resin may be an amorphous resin, a crystalline resin, and/or a mixture of crystalline and amorphous resins. The crystalline resin may be present in the mixture of crystalline and amorphous resins, for example, in an amount of from 0 to about 50 percent by weight of the total toner resin, in embodiments from 5 to about 35 percent by weight of the toner resin. The amorphous resin may be present in the mixture, for example, in an amount of from about 50 to about 100 percent by weight of the total toner resin, in embodiments from 95 to about 65 percent by weight of the toner resin.

In embodiments, the amorphous resin may be selected from the group consisting of polyester, a polyamide, a polyimide, a polystyrene-acrylate, a polystyrene-methacrylate, a polystyrene-butadiene, or a polyester-imide, and mixtures thereof. In embodiments, the crystalline resin may be selected from the group consisting of polyester, a polyamide, a polyimide, a polyethylene, a polypropylene, a polybutylene, a polyisobutyrate, an ethylene-propylene copolymer, or an ethylene-vinyl acetate copolymer, and mixtures thereof. In further embodiments, the resin may be a polyester crystalline and/or a polyester amorphous resin. In embodiments, the polymer utilized to form the resin may be a polyester resin, including the resins described in U.S. Pat. Nos. 6,593,049 and 6,756,176. Suitable resins may also include a mixture of an amorphous polyester resin and a crystalline polyester resin as described in U.S. Pat. No. 6,830,860.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), polyethylene-succinate), poly(propylene-succinate), poly(butylene-succinate), poly(pentylene-succinate), poly(hexylene-succinate), poly(octylene-succinate), poly(ethylene-sebacate), polypropylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanedioate), poly-(ethylene-decanedioate), poly-(ethylene-dodecanedioate), poly(nonylene-sebacate), poly(nonylene-decanedioate), poly(nonylene-dodecanedioate), poly(decylene-dodeanedioate), copoly(ethylene-fumarate)-copoly(ethylene-sebacate), copoly(ethylene-fumarate)-copoly(ethylene-decanedioate), and copoly(ethylene-fumarate)-copoly(ethylene-dodecanedioate). The crystalline resin, when utilized, may be present, for example, in an amount of from about 5 to about 50 percent by weight of the toner components, in embodiments from about 10 to about 35 percent by weight of the toner components.

The crystalline resin can possess various melting points of, for example, from about 30° C. to about 120° C. in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 2 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecenylsuccinic acid, dodecenylsuccinic anhydride, glutaric acid, glutaric anhydride, adipic acid, pimelic acid, suberic acid, azelaic acid, dodecanedioic acid, dimethyl terephthalate, diethyl terephthalate, dimethyl isophthalate, diethyl isophthalate, dimethyl phthalate, phthalic anhydride, diethyl phthalate, dimethyl succinate, dimethyl fumarate, dimethyl maleate, dimethyl glutarate, dimethyl adipate, dimethyl dodecenylsuccinate, and combinations thereof. The organic diacids or diesters may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene glycol, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, polycondensation catalysts may be used in forming the polyesters. Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, tin octoate, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly (propylene-5-sulfo-isophthalate), copoly(diethylene-terephthalate)-copoly(diethylene-5-sulfoisophthalate), copoly (propylene-diethylene-terephthalate)-copoly(propylene-diethylene-5-sulfoisophthalate), copoly(propylene-butylene-terephthalate)-copoly(propylene-butylene-5-sulfoisophthalate), and copoly(propoxylated bisphenol-A-fumarate)-copoly(propoxylated bisphenol A-5-sulfo-isophthalate).

In embodiments, an unsaturated, amorphous polyester resin may be utilized as a latex resin. Examples of such resins include those disclosed in U.S. Pat. No. 6,063,827. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

The amorphous resin can possess various glass transition temperatures (Tg) of, for example, from about 40° C. to about 100° C., in embodiments from about 45° C. to about 70° C., in some embodiments from 50° C. to about 65° C. The crystalline resin may have a number average molecular weight ($M_n$), for example, from about 1,000 to about 50,000, in embodiments from about 2,000 to about 25.000, in some embodiments from about 2,000 to about 10,000 and a weight average molecular weight ($M_w$) of, for example, from about 2,000 to about 100,000, in embodiments from about 3,000 to about 80,000, in some embodiments from about 4,000 to about 20,000, as determined by Gel Permeation Chromatography (GPC) using polystyrene standards. The molecular weight distribution ($M_w/M_n$) of the crystalline resin may be, for example, from about 2 to about 6, in embodiments from about 2 to about 5, and in some embodiments about 2 to about 4.

For example, in embodiments, an amorphous polyester resin may be a poly(propoxylated bisphenol A co-fumarate) resin having the following formula (1):

(1)

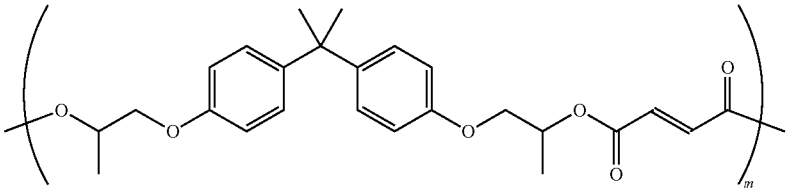

wherein m may be from about 5 to about 1000, in embodiments from about 10 to about 500, in other embodiments from about 15 to about 200. Examples of such resins and processes for their production include those disclosed in U.S. Pat. No. 6,063,827.

An example of a linear propoxylated bisphenol A fumarate resin which may be utilized as a toner resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

In embodiments, the amorphous polyester resin may be a co-polymer of alkoxylated Bisphenol A with at least one diacid. The alkoxylated Bisphenol A may include ethoxylated Bisphenol A, propoxylated Bisphenol A, and/or ethoxylated-propoxylated Bisphenol A. Suitable diacids include fumaric acid, terephthalic acid, dodecenylsuccinic acid, and/or trimellitic acid.

In embodiments, a combination of low Mw and high Mw amorphous resins may be used to form a toner. Low-Mw resins may have a weight-average molecular weight of approximately 10 kg/mol to approximately 20 kg/mol, and a number-average molecular weight of approximately 2 kg/mol to approximately 5 kg/mol. High-Mw resins may have a weight-average molecular weight of approximately 90 kg/mol to approximately 160 kg/mol, and a number-average molecular weight of approximately 4 kg/mol to approximately 8 kg/mol. The ratio, by weight, of low Mw to high Mw amorphous resins may be from about 0:100 to about 100:0, in embodiments from about 70:30 to about 30:70, and in some embodiments from about 60:40 to about 40:60.

Further examples of crystalline resins which may be utilized, optionally in combination with an amorphous resin as descried above, include those disclosed in U.S. Patent Application Publication No. 2006/0222991. In embodiments, a suitable crystalline resin may include a resin formed of ethylene glycol and a mixture of dodecanedioic acid and fumaric acid co-monomers with the following formula (2):

(II)

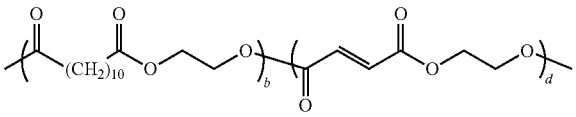

wherein b is from about 5 to about 2000 and d is from about 5 to about 2000.

For example, in embodiments, a poly(propoxylated bisphenol A co-fumarate) resin of formula I as described above may be combined with a crystalline resin of formula II to form a resin suitable for forming a toner.

Examples of other toner resins or polymers which may be utilized include those based upon styrenes, acrylates, methacrylates, butadienes, isoprenes, acrylic acids, methacrylic acids, acrylonitriles, and combinations thereof. Exemplary additional resins or polymers include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propylacrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof. The polymer may be block, random, or alternating copolymers.

In further embodiments, the resins utilized in the toner may have a melt viscosity of from about 10 to about 1,000,000 Pascal-seconds (Pa*s) at about 130° C., in embodiments from about 20 to about 100,000 Pa*s.

One, two, or more toner resins may be used. In embodiments where two or more toner resins are used, the toner resins may be in any suitable ratio (e.g. weight ratio) such as for instance about 10% (first resin)/90% (second resin) to about 90% (first resin)/10% (second resin).

In embodiments, the polymer latex may be formed by emulsification methods. Utilizing such methods, the resin may be present in a resin emulsion, which may then be combined with other components and additives to form a toner of the present disclosure.

The polymer resin may be present in an amount of from about 65 to about 95 percent by weight, in embodiments from about 70 to about 90 percent by weight, and in some embodiments from about 75 to about 85 percent by weight of the toner particles (that is, toner particles exclusive of external additives) on a solids basis. Where the resin is a combination of a crystalline resin and one or more amorphous resins, the ratio of crystalline resin to amorphous resin(s) can be in embodiments from about 1:99 to about 30:70, in embodiments from about 5:95 to about 25:75, in some embodiments from about 5:95 to about 15:85.

Surfactants

In embodiments, resins, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™ IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897 ™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments. DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide. $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the optional colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company. Inc, PIGMENT VIOLET 1™, PIGMENT RED 48™, LEMON CHROME YELLOW DCC 1026™, E.D. TOLUIDINE RED™ and BON RED C™ available from Dominion Color Corporation. Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710. CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF). Sudan III (Matheson. Coleman, Bell), Sudan II (Matheson, (Coleman, Bell), Sudan IV (Matheson. Coleman, Bell). Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF). Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals). Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and optional colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight (Mw) of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N15™ commercially available from Eastman Chemical Products. Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax: mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Shell Resins

In embodiments, a shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, at least one amorphous polyester resin may be utilized to form a shell over the aggregates to form toner particles having a core-shell configuration. In embodiments, an amorphous polyester resin and a crystalline resin may be utilized to form a shell over the aggregates to form toner particles having a core-shell configuration. In embodiments, a suitable shell may include at least one amorphous polyester resin present in an amount from about 10 percent to about 90 percent by weight of the shell, in embodiments from about 20 percent to about 80 percent by weight of the shell, in embodiments from about 30 percent to about 70 percent by weight of the shell.

The shell resin may be present in an amount of from about 5 percent to about 40 percent by weight of the toner particles, in embodiments from about 24 percent to about 30 percent by weight of the toner particles.

Once the desired final size of the toner particles is achieved, the pH of the mixture may be adjusted with a base to a value of from about 5 to about 10, and in embodiments from about 6 to about 8. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. The base may be added in amounts from about 2 to about 25 percent by weight of the mixture, in embodiments from about 4 to about 10 percent by weight of the mixture. Furthermore, the addition of an EDTA solution may be used to freeze the shell growth. In embodiments, a combination of EDTA solution and base solution may be used to freeze the toner particle growth.

Small Molecule Crystalline Aromatic Ether Compounds

In embodiments, small molecule crystalline aromatic ether compounds, which are crystalline solids at room temperature, are added to the toner for reduction in minimum fusing temperature (MFT) of the toner. In particular embodiments, the small molecule crystalline aromatic ether compounds are added to emulsion aggregation (EA) toners, completely or partially replacing a crystalline polymer component, if included, where the small molecule crystalline organic compounds are compatible with the toner amorphous binder resin(s). Compatibility may be shown by characterizing a melt mixture of the amorphous resin and the small molecule crystalline aromatic ether compound(s)—the amorphous resin and small molecule crystalline aromatic ether compound(s) are considered to be compatible when the melt mixture is characterized by a reduction in glass transition temperature from that of the amorphous resin and by the lack of a significant solid to liquid phase transition peak for the small molecule crystalline aromatic ether compound(s) as determined by differential scanning calorimetry, the enthalpy of fusion for the small molecule crystalline aromatic ether compound in the mixture being measured to be less than 20% of its original value, in embodiments less than 10% of its original value, and in some embodiments less than 5% of its original value, said original value representing the enthalpy of fusion for the small molecule when measured independently. Furthermore, in embodiments the small molecule crystalline aromatic ether compounds have a melting point that is less than the fusing temperature of the EA toner. According to some embodiments, emulsion aggregation toners comprising small molecule crystalline aromatic ether compounds may achieve crease fix MFT at least comparable to nominal ULM toners, such as the Xerox® 700 DCP toner available from Xerox Corp. for example, if not lower, by at least 5° C., or by 10° C. to 20° C., for example.

In some embodiments the small molecule crystalline aromatic ether compounds have a molecular weight of less than 1,000 g/mol; in further embodiments, the small molecule crystalline aromatic ether compounds have a molecular weight of less than 750 g/mol; and yet further embodiments the small molecule crystalline aromatic ether compounds have a molecular weight of less than 500 g/mol.

In brief, the compatibility test for the amorphous resin and the small molecule crystalline aromatic ether compounds proceeds as follows. A small molecule crystalline aromatic ether compound is mixed with an amorphous resin in a ratio similar to that in the toner itself. The mixture is heated to at least above the melting point of the crystalline component for a time sufficient for complete melting with mixing, then cooled to room temperature. The resulting material is analyzed by DSC. In this test, small molecules that are not compatible with the resin are thought to re-crystallize from the molten mixture as it cools, and the resulting DSC trace shows both (1) a clear melting peak corresponding to the small molecule and (2) the original glass transition of the amorphous resin (which may or may not be shifted to a slightly lower temperature). When incorporated into an EA toner, small molecules with this characteristic generally do not provide low-melt toner properties. In contrast, small molecules that are compatible with the resin generally do not re-crystallize from the molten mixture. In these cases, the resulting DSC traces show both (1) a weak or completely absent melting transition and (2) a weakened and/or shifted glass transition, indicating plasticization of the amorphous resin by the small molecule. When incorporated into EA toner, these small molecules generally do provide low-melt properties, when the melting point of the small molecules is below the typical fusing temperature of the toner (between about 110° C. and 120° C. for a typical ULM EA toner, such as Xerox® 700 DCP toner, for example). Furthermore, to measure the extent of compatibility, the enthalpy of crystallization may be measured—for full compatibility a value of less than 5% of the original value is obtained, whereas for full incompatibility, a value of greater than 20% of the original value is obtained, said original value representing the enthalpy of fusion for the small molecule when measured independently.

Examples of suitable aromatic ethers include those of the formulas (3):

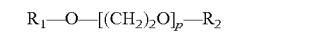

$$R_1—O—[(CH_2)_2O]_p—R_2 \quad \text{(III)}$$

wherein $R_1$ and $R_2$ are independently selected from the group consisting of (i) an alkyl group; (ii) an arylalkyl group; (iii) an alkylaryl group and (iii) an aromatic group; and mixtures thereof, provided that at least one of $R_1$ and $R_2$ is an aromatic group; and p is 0 or 1. Thermal properties of these aromatic ethers for specific examples of $R_1$ and $R_2$ are provided in Table 1.

TABLE 1
Thermal properties of aromatic ethers.
| Compound # | Structure | $T_{melt}$ (° C.)* | $T_{crys}$ (° C.)* | $T_{melt} - T_{crys}$ (° C.) |
|---|---|---|---|---|
| 1 | 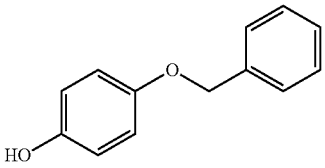 | 121 | 100 | 21 |
| 2 | 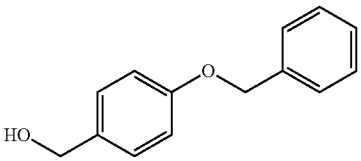 | 90 | 77 | 13 |
| 3 | 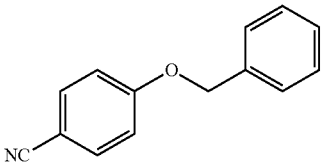 | 97 (1stH) & 81 (2ndH)*** | 36 | 61 |
| 4 | 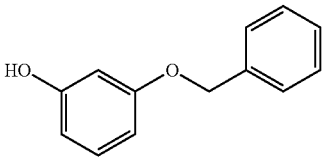 | 50 | ** | ** |
| 5 | 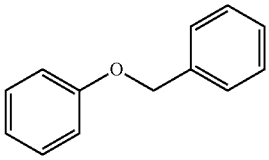 | 39 | ** | ** |
| 6 | 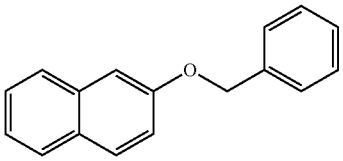 | 102 | 65 | 37 |
| 7 | 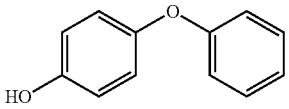 | 88 | 4 (2ndH)*** | 84 |
| 8 | 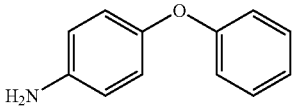 | 85 | 29 | 56 |
| 9 | 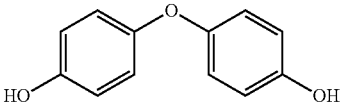 | 168 | ** | ** |
| 10 | 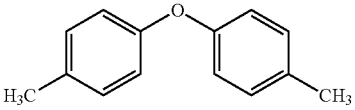 | 48 | ** | ** |

TABLE 1-continued

Thermal properties of aromatic ethers.

| Compound # | Structure | $T_{melt}$ (° C.)* | $T_{crys}$ (° C.)* | $T_{melt} - T_{crys}$ (° C.) |
|---|---|---|---|---|
| 11 | 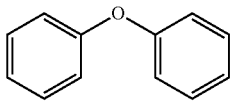 | 26-30 | ** | ** |
| 12 | 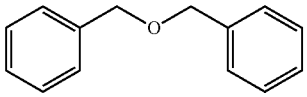 | 4 | ** | ** |
| 13 | 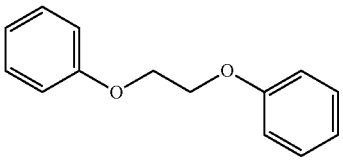 | 98 | 77 | 21 |

*Determined by DSC at a rate of 10° C./min or melting point data from commercial source.
**Data not available or not measured.
***Second Heating In a particular embodiment, the aromatic ether is benzyl 2-naphthyl ether (melting point 102° C.), of the formula (4):

(IV)

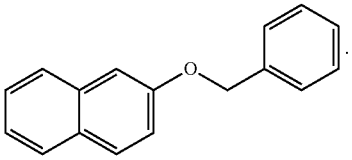

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, for example. In embodiments, toner compositions and toner particles may be prepared by aggregation and coalescence processes in which small-size resin particles are aggregated to the appropriate toner particle size and then coalesced to achieve the final toner particle shape and morphology.

In embodiments, toner compositions may be prepared by emulsion-aggregation processes, such as a process that includes aggregating a mixture of an optional colorant, an optional wax and any other desired or required additives, and emulsions including the resins and at least one or more of the small molecule crystalline aromatic ether compounds described above, optionally in surfactants as described above, and then coalescing the aggregate mixture. Examples of potentially suitable colorants, waxes and/or other additives are described above. In some embodiments the small molecule crystalline aromatic ether compound(s) is about 5% to about 25% by dry weight of the toner, not including any external additives, in embodiments from about 10% to about 20%, and in some embodiments the small molecule crystalline aromatic ether compound(s) is about 15% by dry weight of the toner. In embodiments, emulsions of each of the components are prepared and then combined together. Furthermore, in some embodiments the toner comprises both a small molecule crystalline aromatic ether compound and a crystalline resin. For example, the crystalline resin may be the crystalline polyester resin described above and/or any of the other crystalline resins described herein. In some embodiments the crystalline resin is about 3% to about 20% by dry weight of the toner, not including any external additives, in embodiments from about 5% to about 15%, and in some embodiments the small molecule crystalline organic compound(s) is about 5% to about 10% by dry weight of the toner.

A mixture may be prepared by adding optionally a colorant and/or a wax and/or other materials, which may also be optionally in a dispersion(s) including a surfactant, to the emulsion, which may be a mixture of two or more emulsions containing the resin. The pH of the resulting mixture may be adjusted as needed.

Following the preparation of the above mixture, an aggregating agent or flocculent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature as needed, and holding the mixture at this temperature for the time required to form the desired particle size, while maintaining stirring, to provide the aggregated particles. Once the predetermined desired particle size is reached, emulsions of resins are added to grow a shell, providing core-shell structured particles. The shell is grown until the desired core-shell toner particle size is reached, then the growth process is halted by increasing the pH of the reaction slurry by the addition of a base, such as NaOH, followed by the addition of an EDTA solution.

After halting the particle growth the reaction mixture is heated, to for example 85° C., to coalesce the particles. The toner slurry is then cooled to room temperature, and the toner particles are separated by sieving and filtration, followed by washing and freeze drying.

The characteristics of the toner particles may be determined by any suitable technique and apparatus, as described in more detail below.

EXAMPLES

The examples set forth herein below are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter.

Compatibility studies of examples of the aforementioned small molecule crystalline aromatic ether compounds and an amorphous polyester toner binding resin were investigated by separately melt mixing the small molecule crystalline organic compounds with a low Mw linear amorphous resin A (an alkoxylated bisphenol-A co-polyester with fumaric, terephthalic and dodecenylsuccinic acids). The melt mixing is carried out on a hot plate at 150° C. over a 20 min period, followed by cooling and characterization by DSC. Some specific examples of DSC plots are provided in FIGS. 1 & 2. These plots are discussed in more detail below.

Figure 2:
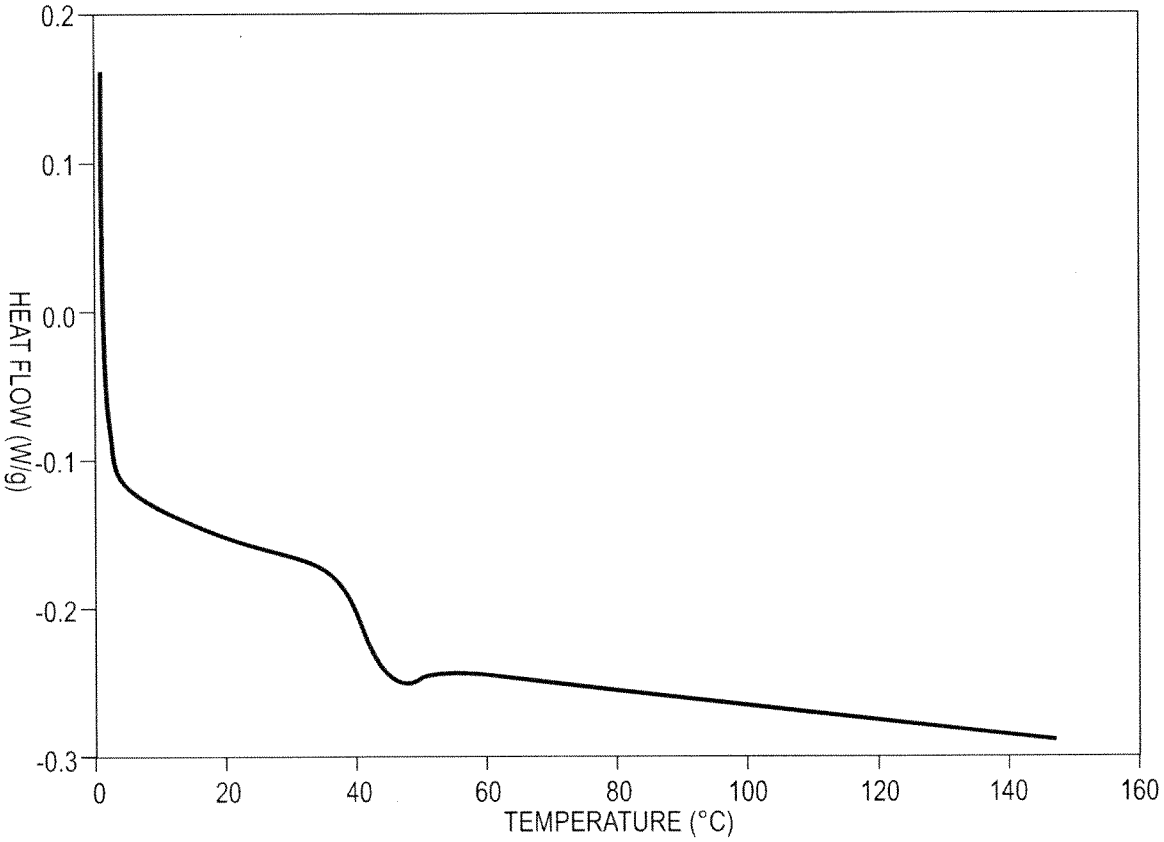
FIG. 2 is a DSC curve of melt mixed benzyl 2-naphthyl ether and an amorphous polyester resin.

The aromatic ether used in an example herein is benzyl 2-naphthyl ether (melting point 102° C.), of the formula (4). Differential scanning calorimetry (DSC) was used to measure the thermal properties of the benzyl 2-naphthyl ether—FIG. 1 shows very sharp melting and recrystallization peaks at about 102° C. and 63° C., respectively. FIG. 2 is a DSC curve of melt mixed benzyl 2-naphthyl ether and linear amorphous polyester resin A. The Tg of resin A was depressed from about 60° C. to about 37.1° C., and no solid to liquid phase transition peak for the crystalline compound was observed, which indicates that benzyl 2-naphthyl ether is fully compatible with the linear amorphous polyester resin A.

Example 1

Preparation of Benzyl 2-Naphthyl Ether Dispersion

Into a 250 ml plastic bottle equipped with about 700 g of stainless steel beads, was added 20 grams of benzyl 2-naphthyl ether obtained from TCI America, 3.34 g of the nonionic surfactant DOWFAX available from the Dow Chemical Co. (47 wt %), and 70 g of deionized water (DIW). The bottle was then milled for 7 days. A dispersion of particle sizes with an average particle diameter of 367 nm was obtained.

Example 2

Preparation of Toner Comprised of 15% Benzyl 2-Naphthyl Ether

Into a 2 liter glass reactor equipped with an overhead mixer was added 165.99 g of the benzyl 2-naphthyl ether dispersion of Example 2 (9.85 wt %), 61.54 g high Mw linear amorphous resin B in an emulsion (35.22 wt %), 62.34 g low Mw linear amorphous resin A in an emulsion (34.84 wt %), 30.56 g wax dispersion (wax available from International Group Inc., 30.19 wt %) and 34.83 g cyan pigment PB15:3 (17.21 wt %). The linear amorphous resin B is a co-polyester of alkoxylated Bisphenol A with terephthalic and dodecenylsuccinic acids. Separately, 3.58 g $Al_2(SO4)_3$ (27.85 wt %) was added as a flocculent under homogenization at 3500 rpm. The mixture was heated to 39.4° C. to aggregate the particles while stirring at 200 rpm. The particle size was monitored with a Coulter Counter until the core particles reached a volume average particle size of 4.40 microns with a GSD volume of 1.26, and then a mixture of 40.55 g and 41.07 g, respectively, of the afore mentioned A and B resin emulsions were added as shell material, resulting in core-shell structured particles with an average particle size of 5.96 microns. GSD volume 1.33. Thereafter, the pH of the reaction slurry was increased to 8 using 4 wt % NaOH solution followed by 7.69 g EDTA (39 wt %) to freeze the toner growth. After freezing, the reaction mixture was heated to 85° C. and the toner particles were coalesced at 85° C. pH 8. The toner was quenched after coalescence, resulting in a final particle size of 6.34 microns, GSD volume of 1.32. GSD number 1.30. The toner slurry was then cooled to room temperature, separated by sieving (25 μm), filtered, and then washed and freeze dried.

Fusing Results

Figure 3:
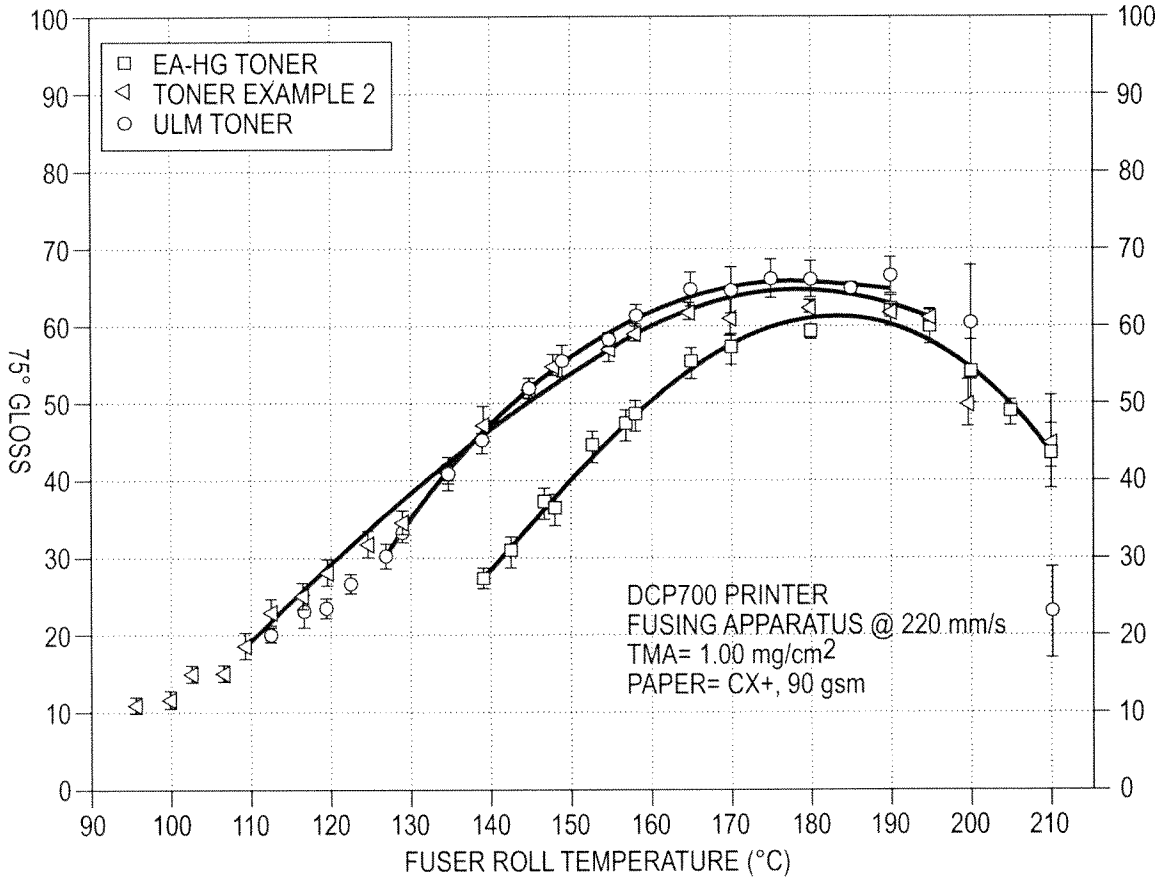
FIG. 3 is a plot of gloss as a function of fuser roll temperature for a toner comprising benzyl 2-naphthyl ether.
Figure 4:
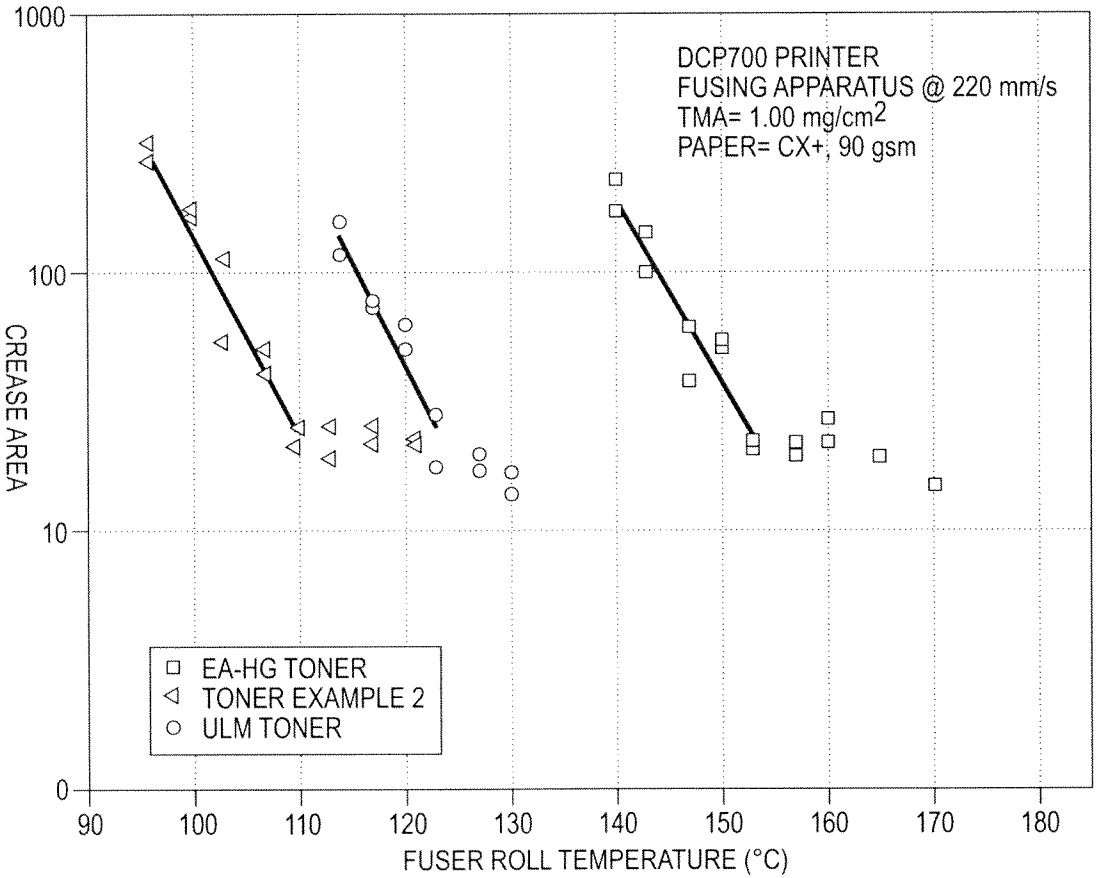
FIG. 4 is a plot of crease area as a function of fuser roll temperature for determining the crease fix MFT of a toner comprising benzyl 2-naphthyl ether.

The toner of Example 2 and controls were evaluated using the fusing apparatus from a Xerox® 700 Digital Color Press printer. The toners were fused at 220 mm/s onto Color Xpressions® paper (90 gsm) with a toner mass per unit area (TMA) of 1.00 mg/cm$^2$ for gloss, MFT, cold offset performance and hot offset performance. The control toners are a Xerox® 700 DCP toner, including a crystalline resin with a melting temperature between 65° C. and 85° C., and a Xerox® EA high-gloss (HG) toner as used in the Xerox® DC250 printer. The temperature of the fuser roll was varied from cold offset to hot offset (up to 210° C.) for gloss and crease measurements. The fusing performance of the toners is shown in FIGS. 3 & 4 and in Table 2.

TABLE 2

Fusing results of toners containing benzyl 2-naphthyl ether

| | ULM Control (Xerox ® 700 DCP toner) | Example 2 |
|---|---|---|
| Crystalline material | Crystalline Resin | 15% benzyl 2-naphthyl ether |
| Cold offset on CX+ | 113 | 100 |
| Gloss at MFT on CX+ | 13.1 | 14.0 |
| Peak Gloss on CX+ | 66.0 | 64.7 |
| T(Gloss 50) on CX+ | 143 | 144 |
| $MFT_{CA=80}$ (extrapolated MFT) | 117 | 104 |

TABLE 2-continued

Fusing results of toners containing benzyl 2-naphthyl ether

| | ULM Control (Xerox ® 700 DCP toner) | Example 2 |
|---|---|---|
| ΔMFT (Relative to Xerox ® EA high-gloss toner fused the same day) | −28 | −41 |
| Mottle/Hot Offset CX+ 220 mm/s | 190/>210 | 200/>210 |
| Fusing Latitude HO-MFT on DCX+ | 73/>93 | 96/>106 |

CX+ and DCX+ are the paper types utilized, available from Xerox Corp.
T(Gloss 50) is the temperature at which the gloss achieved is 50 Gardner gloss units (ggu)
$MFT_{CA-80}$ is the MFT with a crease area of 80 units
Xerox ® EA high-gloss toner as used in the Xerox ® DC250 printer As shown in Table 2, incorporation of the benzyl 2-naphthyl ether in the toner provides a cold offset temperature (100° C. versus 113° C.) and a crease fix MFT (104° C. versus 117° C.) shifted to much lower temperatures relative to the Xerox® 700 DCP toner. (The crease fix MFT values are accurate to roughly ±3 or 4 degrees centigrade.) The mottle/hot offset temperature was higher (200° C. versus 190° C.), which resulted in much larger fusing latitude (96° C. versus 73° C.).

FIGS. 3 & 4 show plots of print gloss and print crease area, respectively, against fusing temperature for the toner of Example 2 containing 15% benzyl 2-naphthyl ether, Xerox® high-gloss toner and the ULM EA Xerox® 700 DCP toner. Relative to the ULM EA control, the toner containing benzyl 2-naphthyl ether exhibits somewhat lower gloss, and relative to both controls a lower crease fix MFT.

Developer Charging Results

Toner samples as described above were blended with Xerox® 700 DCP additives and carrier to provide developer samples. The developer samples were conditioned overnight in A and J zones and then charged using a Turbula mixer for about 60 minutes. The A zone is a high humidity zone at about 28° C. and 85% relative humidity (RH) and the J zone is a low humidity zone at about 21° C. and 10% RH. Toner charge (Q/d) was measured using a charge spectrograph with a 100 V/cm field, and was measured visually as the midpoint of the toner charge distribution. The toner charge per mass ratio (Q/m) was determined by the total blow-off charge method, measuring the charge on a faraday cage containing the developer after removing the toner by blow-off in a stream of air. The total charge collected in the cage is divided by the mass of toner removed by the blow-off, by weighing the cage before and after blow-off to give the Q/m ratio.

The toner of Example 2 was tested and the charging results were found to be acceptable—similar to results for a nominal ULM toner used as a control. Moreover, the toner charging properties may be optimized, improving both Q/m and Q/d for instance, by: adjusting the toner shell thickness; varying the weight percentage of crystalline material; incorporating both small molecule crystalline aromatic ethers and a crystalline polymer and optimizing the ratio; adjusting the toner agglomeration/coalescence process, for instance adjusting the coalescence temperature.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A toner comprising:

a polymeric resin comprising a combination of a low molecular weight linear amorphous resin and a high molecular weight linear amorphous resin in a weight ratio range of from about 70:30 to about 30:70, wherein the low molecular weight linear amorphous resin has a weight-average molecular weight of approximately 10 kg/mol to approximately 20 kg/mol, and high molecular weight linear amorphous resin has a weight-average molecular weight of approximately 90 kg/mol to approximately 160 kg/mol;

optionally a colorant; and a small molecule crystalline aromatic ether having a molecular weight less than 1,000 g/mol having the formula:

$$R_1—O—[(CH_2)_2O]_p—R_2,$$

wherein $R_1$ and $R_2$ are independently selected from the group consisting of an alkyl group, an arylalkyl group, an alkylaryl group, and an aromatic group, wherein at least one of $R_1$ and $R_2$ is an aromatic group, and wherein p is 0 or 1, further wherein the small molecule crystalline aromatic ether is about 5% to about 25% by dry weight of the toner particles.

2. The toner of claim 1, wherein the small molecule crystalline aromatic ether has a melting point of less than about 120° C.

3. The toner of claim 1, wherein the small molecule crystalline aromatic ether is benzyl 2-naphthyl ether having the formula:

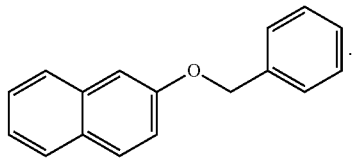

4. The toner of claim 1, further comprising a crystalline polymeric resin.

5. The toner of claim 4, wherein the crystalline polymeric resin is a crystalline polyester resin.

6. The toner of claim 1, wherein the toner is an emulsion aggregation toner.

7. The toner of claim 1, wherein a mixture of the amorphous polymeric resin and the small molecule crystalline aromatic ether exhibits a reduction in glass transition temperature from that of the amorphous polymeric resin and a lack of a significant solid to liquid phase transition peak for the small molecule crystalline aromatic ether as determined by differential scanning calorimetry, the enthalpy of fusion for the small molecule crystalline aromatic ether in the mixture being measured to be less than 10% of the enthalpy of fusion of the small molecule crystalline aromatic ether in pure form.

8. The toner of claim 1, wherein the polymeric resin is a polyester resin.

9. The toner of claim 1, wherein the toner has a crease fix minimum fusing temperature less than or equal to the crease fix minimum fusing temperature of an ultra-low-melt emulsion aggregation toner, wherein the crease fix minimum fusing temperature measurements of the toner and the ultra-low-melt aggregation toner are carried out using a same fuser under nominally identical conditions.

10. The toner of claim 9, wherein the crease fix minimum fusing temperature of the toner is at least 5° C. less than the crease fix minimum fusing temperature of the ultra-low-melt emulsion aggregation toner.

11. The toner of claim 1, wherein the high molecular weight linear amorphous resin comprises a co-polymer of alkoxylated Bisphenol A with terephthalic and dodecenylsuccinic acids.

12. An emulsion aggregation toner comprising:

polymeric resin comprising a combination of a low molecular weight linear amorphous resin and a high molecular weight linear amorphous resin in a weight ratio range of from about 70:30 to about 30:70, wherein the low molecular weight linear amorphous resin has a weight-average molecular weight of approximately 10 kg/mol to approximately 20 kg/mol, and high molecular weight linear amorphous resin has a weight-average molecular weight of approximately 90 kg/mol to approximately 160 kg/mol;

optionally a colorant; and a small molecule crystalline aromatic ether having a molecular weight less than 500 g/mol, and a melting point of less than about 120° C., the small molecule crystalline aromatic ether having the formula:

$$R_1—O—[(CH_2)_2O]_p—R_2,$$

wherein $R_1$ and $R_2$ are independently selected from the group consisting of an alkyl group, an arylalkyl group, an alkylaryl group, and an aromatic group, wherein at least one of $R_1$ and $R_2$ is an aromatic group, and wherein p is 0 or 1, further wherein the small molecule crystalline aromatic ether is about 5% to about 25% by dry weight of the toner particles;

wherein a mixture of the amorphous polymeric resin and the small molecule crystalline aromatic ether exhibits a reduction in glass transition temperature from that of the amorphous resin and a lack of a significant solid to liquid phase transition temperature from that of the amorphous polymeric resin and by the lack of a solid to liquid phase transition peak for the small molecule crystalline aromatic ether as determined by differential scanning calorimetry, the enthalpy of fusion for the small molecule crystalline aromatic ether in the mixture being measured to be less than 10% of the enthalpy of fusion of the small molecule crystalline aromatic ether in pure form.

13. The toner of claim 12, wherein the toner is configured to have a crease fix minimum fusing temperature less than or equal to the crease fix minimum fusing temperature of an ultra-low-melt emulsion aggregation toner, wherein the crease fix minimum fusing temperature measurements of the toner and the ultra-low-melt emulsion aggregation toner are carried out using a same fuser under nominally identical conditions.

14. The toner of claim 13, wherein the crease fix minimum fusing temperature of the toner is at least 5° C. less than the crease fix minimum fusing temperature of the ultra-low-melt emulsion aggregation toner.

15. A method for making toner particles comprising:

admixing polymeric amorphous resin emulsion, optionally at least one colorant emulsion, optionally a wax emulsion, and a small molecule crystalline aromatic ether emulsion, the small molecule crystalline aromatic ether having a molecular weight less than 1,000 g/mol and having the formula:

$$R_1—O—[(CH_2)_2O]_p—R_2,$$

wherein $R_1$ and $R_2$ are independently selected from the group consisting of an alkyl group, an arylalkyl group, an alkylaryl group, and an aromatic group, wherein at least one of $R_1$ and $R_2$ is an aromatic group, and wherein p is 0 or 1, further wherein the small molecule crystalline aromatic ether is about 5% to about 25% by dry weight of the toner particles, to form a composite emulsion, wherein the polymeric amorphous resin emulsion comprises a combination of a low molecular weight linear amorphous resin and a high molecular weight linear amorphous resin in a weight ratio range of from about 70:30 to about 30:70, wherein the low molecular weight linear amorphous resin has a weight-average molecular weight of approximately 10 kg/mol to approximately 20 kg/mol, and high molecular weight linear amorphous resin has a weight-average molecular weight of approximately 90 kg/mol to approximately 160 kg/mol; and adding an aggregating agent to the composite emulsion to form emulsion aggregation toner particles.

16. The method of claim 15, wherein a mixture of the amorphous polymeric resin and the small molecule crystalline aromatic ether exhibits a reduction in glass transition temperature from that of the amorphous polymeric resin and a lack of a significant solid to liquid phase transition peak for the small molecule crystalline aromatic ether as determined by differential scanning calorimetry, the enthalpy of fusion for the small molecule crystalline aromatic ether in the mixture being measured to be less than 10% of the enthalpy of fusion of the small molecule crystalline aromatic ether in pure form.

17. The method of claim 15, wherein the small molecule crystalline aromatic ether has a melting point of less than about 120° C.

* * * * *